US007299569B2

(12) United States Patent
Kanzler

(10) Patent No.: US 7,299,569 B2
(45) Date of Patent: Nov. 27, 2007

(54) SNOW-TRAIL GROOMING VEHICLE AND METHOD FOR CONTROLLING SAME

(75) Inventor: Helmut Kanzler, Illerberg (DE)

(73) Assignee: Kaessbohrer Gelaendefahrzeug AG, Laupheim (DE)

( * ) Notice: Subject to any disclaimer, the term of this patent is extended or adjusted under 35 U.S.C. 154(b) by 34 days.

(21) Appl. No.: 10/705,210

(22) Filed: Nov. 7, 2003

(65) Prior Publication Data

US 2004/0144000 A1 Jul. 29, 2004

(30) Foreign Application Priority Data

Nov. 8, 2002 (DE) ..... 102 53 412

(51) Int. Cl.
*E01H 4/00* (2006.01)

(52) U.S. Cl. ..... 37/221; 37/197; 701/50

(58) Field of Classification Search ..... 37/196, 37/197, 219–229, 266; 701/50
See application file for complete search history.

(56) References Cited

U.S. PATENT DOCUMENTS 4,057,916 A * 11/1977 Roemer ..... 37/223
4,127,949 A * 12/1978 Sabrowsky et al. ..... 37/221
5,002,148 A * 3/1991 Miyake et al. ..... 180/197
6,591,593 B1 * 7/2003 Brandon et al. ..... 56/10.6
6,879,895 B2 * 4/2005 Capps et al. ..... 701/36
6,904,708 B2 * 6/2005 Rogers ..... 37/228
2002/0156574 A1 10/2002 Fortin

FOREIGN PATENT DOCUMENTS

DE 100 45 524 A1 3/2002
EP 0 242 437 A2 10/1987
EP 0 895 495 B1 2/1999
WO WO 01/55511 A2 8/2001

* cited by examiner

*Primary Examiner*—Thomas B. Will
*Assistant Examiner*—Alicia Torres
(74) *Attorney, Agent, or Firm*—Flynn, Thiel, Boutell & Tanis, P.C.

(57) ABSTRACT

A method for controlling a snow-trail grooming vehicle for grooming snow trails and especially for distributing the driving power which is made available by a drive motor of a snow-trail grooming vehicle onto a chain or track drive thereon and further consumers. According to the invention, the distribution of the driving power or control by a central processing system occurs as the central processing system varies distribution of the driving power in dependency of a specifiable, changeable prioritizing of the drive and at least one consumer or groups of consumers.

12 Claims, 3 Drawing Sheets

SNOW-TRAIL GROOMING VEHICLE AND METHOD FOR CONTROLLING SAME

FIELD OF THE INVENTION

The invention relates to a method for controlling a snow-trail grooming vehicle. The invention also relates to a snow-trail grooming vehicle to carry out the method of the invention.

BACKGROUND OF THE INVENTION

A snow-trail grooming vehicle is known from the international patent publication WO 01/55511 A2, with which a vehicle speed can be detected above a snow surface by means of a radar speed detector arranged on the vehicle. The chain speed is compared with this vehicle speed and a slip is calculated from these values. Based on the calculated slip a chain tension can be automatically adjusted. The snow-trail grooming vehicle described in this reference provides furthermore that an operator specifies, when using a half-pipe shaver, a target angle and a tolerance for the half-pipe shaver. The actual operating angle of the half-pipe shaver is monitored and the half-pipe shaver can be automatically controlled in view of a maintaining of the target angle. The thickness of the snow under the vehicle can be determined by means of radar penetrating through the snow to the earth, and a map with snow-thickness informations can be set up by combining the thickness of the snow determined by means of the radar and by means of position data collected by a GPS navigation system. The snow-trail grooming vehicle has detecting and indicating devices for a slope incline and for the adjustment of snow-trail grooming devices.

The operation of a snow-trail grooming vehicle is simplified with the invention.

SUMMARY OF THE INVENTION

According to the invention, a method for controlling a snow-trail grooming vehicle, especially for distributing the driving power, which is made available by a drive motor onboard the snow-trail grooming vehicle, onto a chain or track drive and further consumers, is provided, with which method the distribution of the power occurs by control of a central processing system, whereby by means of the central processing system a varying distribution of the power can be adjusted in dependency of a given changeable prioritizing of the drive of at least one consumer and/or of groups of consumers.

With a prioritizing of the drive or of consumers it can, for example, be assured that a snow-trail grooming vehicle prepares a snow trail to an optimum even when the operator is inexperienced, for example, by a shaving power being at all times sufficient in order to achieve a desired snow-surface quality. By a prioritizing of the shaver it can be avoided that due to an error in operation too little shaving power is available in order to achieve the desired result. On the other hand, getting the snow-trail grooming vehicle stuck on a steep slope can be avoided by a prioritizing of the chain or track drive when in critical situations the driving power, which is made available for further consumers, for example a rear shaver, is clearly reduced. Besides the drive consumers are, for example, a rear shaver, a front snow blower, a clearing blade, a cable winch, a motor-cooling or oil-cooling fan, a half-pipe shaver, a cross country ski trail grooming device or the like. It is moreover possible to prioritize groups of consumers. For example, it is possible to prioritize a cable winch and the drive on steep sections and during a winding operation. To achieve a most optimum snow-surface quality, it could be possible to prioritize a group of consumers, which consist of the clearing blade and a rear shaver.

A prioritizing of the driving power, at least of one snow-trail grooming device and/or a cable winch, can be selectively adjusted in a further development of the invention.

A clear improvement is achieved in this manner through a clear control input. Thus it is, for example, possible to prioritize the driving power during pure traveling operation, whereas during the grooming operation one or several snow-trail grooming devices are prioritized. When the cable winch is utilized on steep sections, the cable winch is always prioritized. With the described prioritizings, it is already possible to avoid a large part of common operating errors.

Threshold values for the driving power available for the further consumers and/or the drive are in a further development of the invention specified during the prioritizing of individual consumers.

In this manner it can, for example, be prevented that a snow-trail grooming vehicle is stopped during a prioritizing of snow-trail grooming devices since sufficient power no longer exists for the chain or track drive. In reverse, it can, for example, be prevented that during a prioritizing of the chain or track drive insufficiently worked snow surface is achieved by making sure that the snow-trail grooming devices have sufficient power available for achieving a satisfactory result.

A further development of the invention provides that the threshold values are specified for output parameters of the driving power, like driving speed, and/or output parameters of the further consumers, like shaving speed.

These measures assure on the one hand a continuous sufficient traveling power of the snow-trail grooming vehicle, and a continuous satisfactory quality of the worked snow surface.

A further development of the invention provides that in dependency of environmental parameters, like slope incline, cable-winch operation, snow density, snow temperature and/or snow height, an change of the prioritizing is suggested by the processing system to an operator or is automatically carried out.

These measures make the opereation of a snow-trail grooming vehicle significantly easier since the necessary change of a prioritizing is suggested to an operator or is even taken away from him. For example, during transitions from flat sections to steep sections a switching between a prioritixing of snow-trail grooming devices and to a prioritizing of the driving power should occur in order to prevent the snow-trail grooming vehicle from getting stuck. By carrying out such a change automatically in dependency of a slope incline, operating errors are avoided. As a result of the change of the prioritizing it is, for example possible to automatically reduce the shaving depth of a rear shaver and/or a bearing pressure thereof on the snow surface. It is also, for example, possible to change in dependency of the slope incline the position of a clearing blade in order to prevent the so-called digging in of the snow-trail grooming vehicle. Moreover, it is possible, for example, during a transition from natural snow to artificial snow, which can be determined using the snow density and snow temperature environmental parameters, to carry out a varying prioritizing and also adjustment of the snow-trail grooming devices in order to at all times achieve a snow surface which has been worked to an optimum.

A further development of the invention provides that by controlling the central processing system an adaptation of the adjustment of the drive motor, of a hydraulic pump driven by the drive motor, and of a hydrostatic gear of the chain or track drive is carried out in order to obtain the desired distribution of the power with little power loss.

An optimization of the efficiency can be achieved with these measures through the adaptation of motor, pump and gear adjustment.

A further development of the invention provides that by controlling the central processing system a braking power created by means of a hydraulic brake or a hydraulic pump coupled with the gear drive is distributed onto the several consumers.

In this manner it is possible, for example, during downhill travel that the rear shaver is driven through the braking power. The energy consumption of a snow-trail grooming vehicle can through this be clearly reduced.

A method for controlling a snow-trail grooming vehicle with a central processing system provides advantageously that traveling programs, which can be specified by means of the central processing system, can be specified on the basis of which the central processing system suggests to an operator or automatically carries out an adjustment of a drive motor, of a drive, and/or of further consumers, like a snow-trail grooming device or a cable winch.

Even an inexperienced operator of a snow-trail grooming vehicle can achieve through these measures a desired snow surface or a desired snow-trail profile. For example, a desired snow-surface quality can be specified, and the central processing system adjusts the provided snow-trail devices or suggests their adjustment so that the desired result is achieved. For example, it is also possible to specify a traveling program for creating a slalom course with high-bank curves, pursuant to which the central processing system suitably adjusts the drive, the clearing blade and a rear shaving device in order to achieve the desired contour and snow-surface quality of the slalom course. As an alternative, a traveling program can be adjusted for transport purposes, with which program a maximum traveling speed is achieved. Furthermore, traveling programs are possible in order to achieve a maximum hill climbing ability or a minimum energy consumption.

A further development of the invention provides that the adjustment of the drive motor, of the chain or track drive, and/or of further consumers within a traveling program occurs in dependency of environmental parameters, like the position of the snow-trail grooming vehicle, the height of the snow, the density of the snow, and the snow temperature, the slope incline and the like.

It is possible in this manner to set up by means of a traveling program, for example, a fun park with a half-pipe shaver in dependency of a GPS position (global positioning system) of the snow-trail grooming vehicle. A further example is the variably high forming of moguls in dependency of the slope incline. Moreover, for example, when creating a ramp a desired ramp angle can be achieved. Also possible is the creation of a traveling path with high-bank curves at predefined positions in the terrain, which are determined by a GPS navigational system.

With a method for controlling a snow-trail grooming vehicle, especially for determining a density of the snow, the density of the snow is advantageously determined by means of a resistance measurement of the snow in the area of the snow-trail grooming vehicle and a subsequent processing of the measured values in a central processing system.

It is possible in this manner, if necessary, in connection with a snow-temperature measurement, to differentiate between artificial snow and natural snow. For example, there exists also the differentiation between new snow and existing snow, crusted snow and other similar snow. This is of importance for a method for controlling a snow-trail grooming vehicle for the adjustment of snow-trail grooming devices.

The resistance measurement occurs in a further development of the invention by means of at least two electrodes, which are in contact with the snow in the area of the snow-trail grooming vehicle and move along with the snow-trail grooming vehicle.

A resistance measurement by means of at least two electrodes permits a reliable determination of the density of the snow with little effort. To improve the measuring results clearly more than two electrodes can be used in order to be able to find several obtained measured values.

A method for controlling a snow-trail grooming vehicle provides advantageously that a measurement of the true traveling speed above ground occurs by means of a navigational system and that a measurement of a chain speed occurs, whereby in a central processing system there occurs a processing of the true traveling speed and of the chain speed in order to determine slip.

In this manner it is possible to determine a true traveling speed reliably and by use of standardized navigational systems. The slip can be reliably determined in this manner by simple means.

A further development of the invention provides that the central processing system checks and, if necessary, changes in dependency of the determined slip a chain tension, a chain speed, and/or adjustments of snow-trail grooming devices.

For example, when a large amount of slip occurs, a clearing blade and a shaver can be lifted or the chain speed can be reduced.

A further development of the invention provides that a measuring of the true traveling speed occurs by means of a satellite navigational system, a terrestrial navigational system, and/or an inertial navigational system, and a processing of the collected data in the central processing system.

In order to determine the true traveling speed various navigational systems or a combination of various navigational systems can be utilized. Especially through a combination of various systems a high precision of the determination of the traveling speed can be achieved. Such navigational systems can be, for example, the GPS system (global positioning system), a radio bearing or optical bearing with cameras of terrestrial reference points, and/or a plotting of the path covered by one reference point by means of a gyrostatic compass.

The invention relates also to a snow-trail grooming vehicle, comprising a drive motor, a chain or track drive, and further consumers and means for distributing a driving power onto the chain or track drive and/or the further consumers, in which a central processing system is provided for controlling the means for distributing the power, which has devices for specifying a changeable prioritizing of the chain or track drive or of the further consumers during the distribution of the power.

A further development of the invention provides that the central processing system has devices for specifying threshold values for the power made available to the chain or track drive or further consumers, and/or threshold values for output parameters of the drive and/or the further consumers.

A further development of the invention provides in a snow-trail grooming vehicle means for determining environmental parameters, like the slope incline, cable-winch operation, density of the snow, temperature of the snow, and/or height of the snow.

A further development of the invention provides that the inventive snow-trail grooming vehicle has a controllable hydraulic pump driven by the drive motor, and a controllable hydrostatic gear for the chain or track drive, and the central processing system has devices for adaptation of the adjusting of the drive motor, of the hydraulic pump, and of the hydrostatic gear of the chain or track drive with regard to little loss.

A further development of the invention provides that the inventive snow-trail grooming vehicle is provided with a hydraulic brake or a hydraulic pump coupled to the gear drive, and the central processing system has devices for distributing a braking power, which is produced by the hydraulic brake or by the hydraulic pump, onto the several consumers.

A snow-trail grooming vehicle has advantageously a central processing system and means for measuring the density of the snow, whereby the means for measuring the density of the snow have at least two electrodes, which are arranged in the form of a rake, for the resistance measurement of the snow.

Such a rake can, for example, trail or can be arranged under the snow-trail grooming vehicle, and permits a reliable resistance determination of the snow in the area of the snow-trail grooming vehicle. When using several electrodes several measured values can be detected and averaged. The arrangement of the electrodes in form of a rake permits, for example, also the simultaneous determination of the temperature of the snow by means of a temperature sensor arranged in the area of the electrodes.

BRIEF DESCRIPTION OF THE DRAWINGS

Further characteristics and advantages of the invention result from the claims and the following description of a preferred embodiment of the invention in connection with the drawings, in which:

DETAILED DESCRIPTION

The invention will be discussed in connection with FIGS. 1 to 5. Whereas FIGS. 1 to 4 illustrate a snow-trail grooming vehicle with various snow-trail grooming devices, FIG. 5 illustrates the operative control and connections between the individual components.

Figure 1:
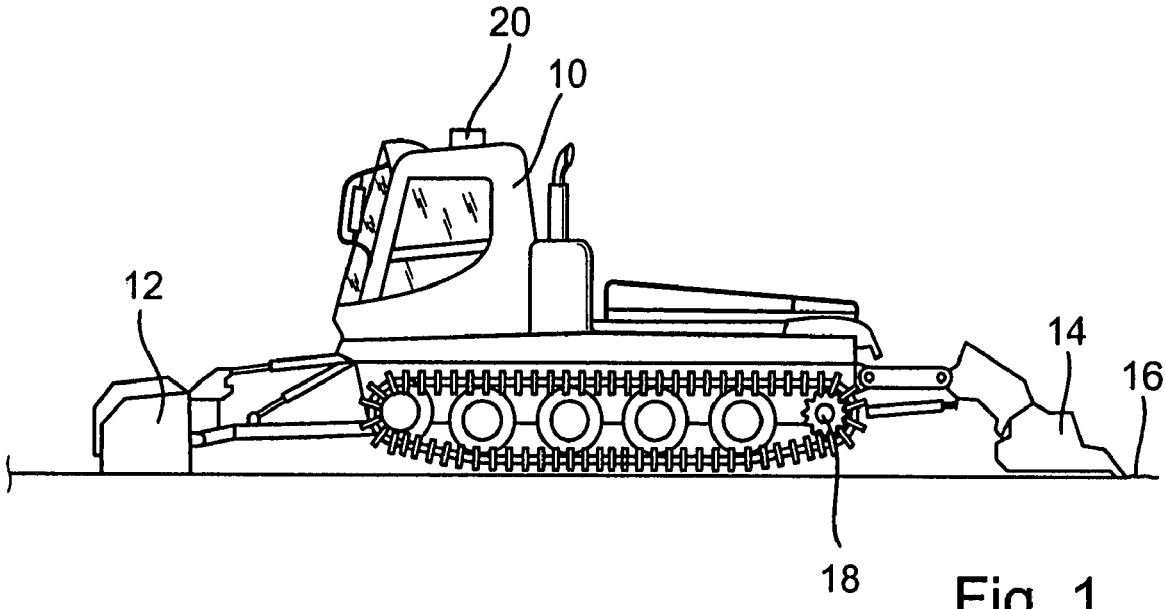
FIG. 1 is a side view of an inventive snow-trail grooming vehicle with a clearing blade and a rear shaving device.

According to FIG. 1 a snow-trail grooming vehicle 10 is provided with a clearing blade 12. The clearing blade 12 can be adjusted in its position in a conventional manner relative to the snow-trail grooming vehicle 10 by means of hydraulic cylinders. The snow-trail grooming vehicle is furthermore equipped with a rear shaving device 14 and a so-called finisher 16. Also in a conventional manner it is possible to adjust the rear shaving device 14 and the finisher relative to the snow-trail grooming vehicle 10 by means of hydraulic cylinders, and a shaving speed of the rear shaving device 14 can be changed. The snow-trail grooming vehicle 10 has a drive motor, which is not shown in FIG. 1, and which drives a hydraulic pump. The hydraulic output produced by the hydraulic pump is distributed by suitable means to the individual consumers, for example, a drive for chains or a track 18, the shaving drive of the rear shaving device 14, the hydraulic cylinders for adjusting the clearing blade 12, and the rear shaving device 14, and the finisher 16, and a chain-tensioning system for the chains or tracks 18. Further consumers are, for example, fans for cooling the drive motor and cooling the hydraulic oil. The snow-trail grooming vehicle 10 has furthermore a receiver 20 for a satellite navigational system, which is schematically indicated in FIG. 1. Further sensors detect a slope incline, which means an incline of the snow-trail grooming vehicle 10 about the longitudinal axis and about a transverse axis. Furthermore the snow-trail grooming vehicle 10 can be equipped with devices for storing a terrain profile so that by utilizing the actual position determined by means of the satellite navigational system or further navigation systems and an actual traveling direction, an anticipating adjustment of the snow-trail grooming devices and, if necessary, of further consumers can be carried out. For example, it is then possible, when an incline lies ahead, to already increase the fan speed, to reduce a traveling speed, and to slowly bring the snow-trail grooming devices into the position needed for the steep-slope travel. The snow-trail grooming vehicle 10 has furthermore sensors for determining the resistance of the snow and of the snow temperature in the area of the snow-trail grooming vehicle 10. Devices, which are suited for this, can be designed, for example, in the form of several electrodes and/or temperature sensors, which make contact with the snow via a rake in the area of the finisher 16 or under the vehicle 10 itself.

Figure 2:
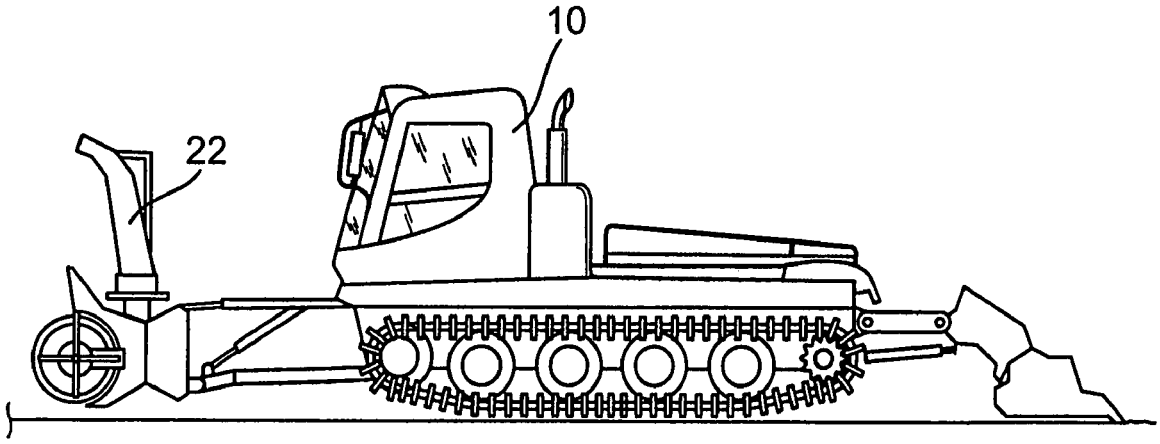
FIG. 2 illustrates an inventive snow-trail grooming vehicle with a front snow blower and rear shaving device.
Figure 3:
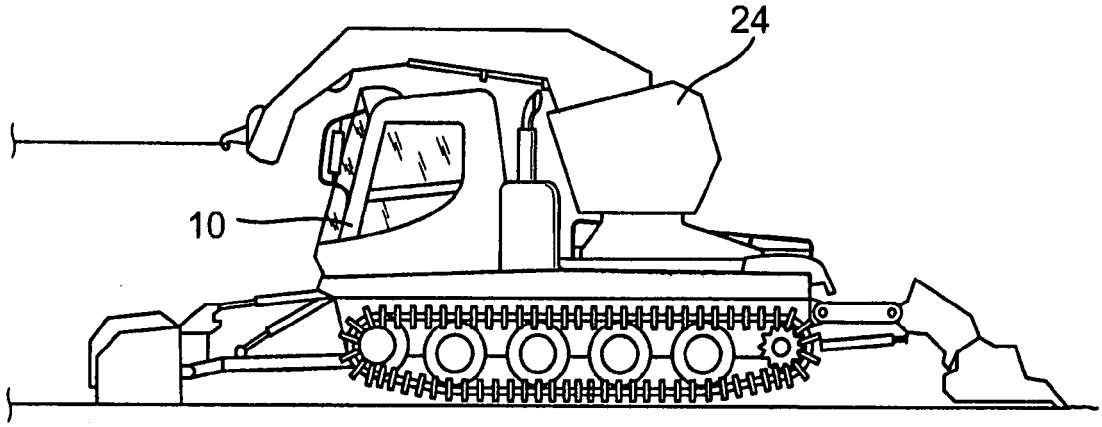
FIG. 3 illustrates an inventive snow-trail grooming device with a clearing blade, a cable winch, and rear shaving device.
Figure 4:
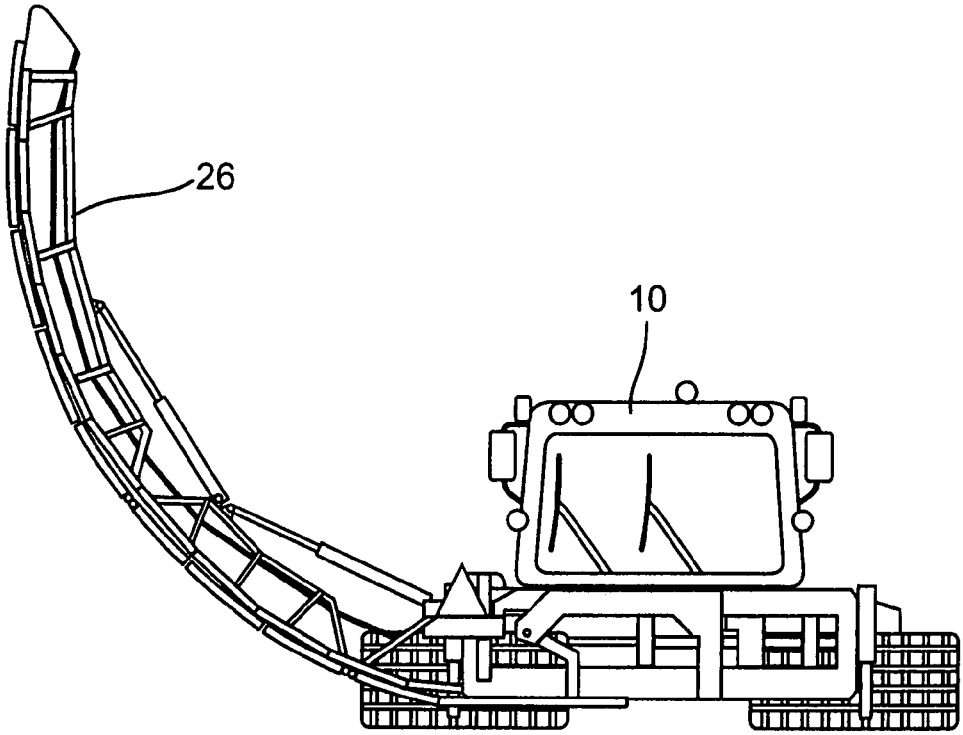
FIG. 4 is a front view of an inventive snow-trail grooming vehicle with a half-pipe shaving device.

FIGS. 2 to 4 show the snow-trail grooming vehicle 10 which is equipped with further components. For example, FIG. 2 shows the snow-trail grooming vehicle 10 which is equipped with a front snow blower 22 in place of the clearing blade of FIG. 1. FIG. 3 shows the snow-trail grooming vehicle 10 being equipped with a cable winch 24. The front view of FIG. 4 illustrates the snow-trail grooming device 10 which has a half-pipe shaver 26 in place of the clearing blade.

Figure 5:
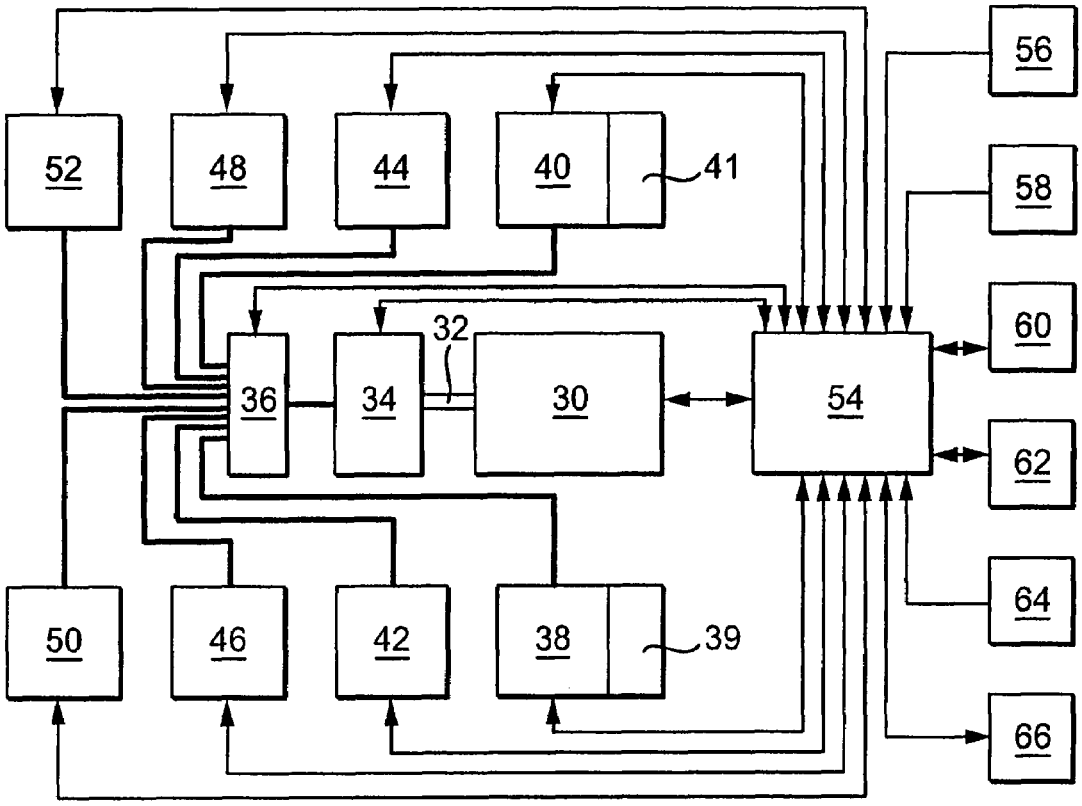
FIG. 5 illustrates a block diagram of an inventive control for a snow-trail grooming vehicle.

The block diagram of FIG. 5 illustrates the individual components of the snow-trail grooming vehicle and their operative connections. Thus, a drive motor 30 drives a hydraulic pump 34 through a shaft 32. The hydraulic fluid conveyed by the hydraulic pump 34 is distributed by means of a distributor 36 to the various consumers. It must thereby be noted that FIG. 5 illustrates the hydraulic lines as thick lines. In contrast, electrical signal connections are illustrated as thinner lines with arrows or double arrows.

The driving power of the drive motor 30 is distributed, for example, to a right chain or track drive 38 and a left chain or track drive 40 by the distributor 36. Furthermore a right chain-tension adjuster 42 and a left chain-tension adjuster 44 is supplied with power. The chain-tension adjusters 42 and 44 are provided for changing the tension of the right or left chain, which is driven by a respective drive 38 or 40. A hydraulic brake 39, 41 is provided on each of the drives 38, 40, with which hydraulic brakes during downhill travel the kinetic energy of the snow-trail grooming vehicle is converted and made available to consumers, for example to a snow-trail grooming device. The energy consumption can in this manner be significantly reduced.

A rear shaving device with finisher 46 and a front snow-trail grooming device 48 are as further consumers connected to the distributor 36. The front snow-trail grooming device 48 can according to FIGS. 1 to 4 be designed as a clearing blade 12, as a front snow blower 22, or as a half-pipe shaver 26. The distributor 36 finally also distributes the power onto a cable winch 50 and a fan 52, whereby the fan for cooling the drive motor and the fan for cooling the oil are illustrated combined in FIG. 5.

The snow-trail grooming vehicle has a central processing system 54, which assumes many control and regulating functions in the snow-trail grooming vehicle 10 and is equipped, for example, with microprocessors and stores. The central processing system 54 receives information signals from all components of the snow-trail grooming vehicle, which components are illustrated in FIG. 5, and also sends control signals to these components in order to carry out suitable adjustments on these components. The exchange of informations between the components and the processing system 54 is indicated by arrows or double arrows. It must be stated in this connection that the functional blocks schematically illustrated in FIG. 5, namely the drives 38, 40, the chain-tension adjusters 42, 44, the snow-trail grooming devices 46, 48 at the rear or at the front of the snow-trail grooming vehicle, and the winch 50 and the fans 52 also include the necessary control systems and sensors, in order to send, for example, the actual position, the actual speed or similar parameters from one of the operational blocks to the central processing system 54, and in reverse, in order to receive control signals from the central processing system 54 and to convert these into suitable control systems, and to in this manner change, for example, a position of a snow-trail grooming device through the control of hydraulic cylinders or a shaving speed through control of a shaving motor. Moreover also the drive motor 30, the hydraulic pump 34 and the distributor 36 are provided with suitable sensors and control systems in order to transfer informations regarding the actual adjustments and parameters to the central processing system 54, and in order to be able to convert control signals from the central processing system 54 into the desired adjustments. For example, the central processing system 54 correlates the drive motor 30, hydraulic pump 34 and drives 38, 40 to one another with a sufficient efficiency. For example, it is possible to correlate a conveying capacity of the hydraulic pump 34 and a transmission ratio of hydrostatic gears in the drives 38, 40 to one another.

The central processing system 54 receives moreover input signals from one or several navigational systems 56 in order to determine an actual position of the snow-trail grooming vehicle. It is in an actually conventional manner also possible to determine by means of the navigational systems 56 and the central processing system 54 a position of the snow-trail grooming vehicle on a stored ground profile in order to obtain informations regarding the terrain to be expected in dependency of the actual traveling direction of the snow-trail grooming vehicle. The navigational systems 56 can include, for example, a satellite navigational system, a terrestrial navigational system, for example, by means of radio or optic bearing of reference points, and an inertial navigational system, where the determination of positions occurs by means of a gyrostatic compass and the distances covered since a known reference point.

Furthermore the central processing system 54 receives sensor signals of an incline sensor 58, through which a slope incline can be determined through the incline of the vehicle about its longitudinal axis and about its transverse axis.

A measuring rake 60 is moreover provided which has several measuring electrodes arranged spaced from one another and can be brought into contact with the snow in the area of the snow-trail grooming vehicle. A resistance of the snow is measured between the electrodes of the measuring rake 60 and is forwarded to the central processing system 54. Pursuant to a control signal of the central processing system 54 the measuring rake 60 is lowered into or lifted out of the snow. Furthermore snow-temperature sensors 62 are provided, which are advantageously also fastened on the measuring rake 60 so that together with a resistance measurement the temperature of the snow can be detected. From the detected resistance and the snow temperature it is possible for the central processing system 54 to classify the snow in the area of the snow-trail grooming vehicle, for example, whether artificial snow or natural snow exists, and as a result to indicate suitable adjustments for the snow-trail grooming devices.

The central processing system 54 receives moreover informations from a snow-height measuring system 64. In dependency of the measured snow height it is possible for the central processing system 54 to specify adjustments for the snow-trail grooming devices, for example, to change a position of the clearing blade in order to remove snow from areas with high snow and move such snow into areas with little snow.

Finally an indicating and input device 66 is provided, on which informations transferred from the central processing system 54 can be indicated, and by means of which adjustments can be specified by an operator. The adjustments desired by the operator are transferred in form of signals to the central processing system 54, which then takes care of the desired adjustment of the components. The indicating and operating system 66 can, for example, indicate adjustments for snow-trail grooming devices and traveling speed, which adjustments are suggested by the central processing system 54, and an operator has then the choice to accept the suggestion or to self-actingly carry out an adjustment. Moreover it is also possible that the central processing system 54 carries out necessary adjustments automatically and informs an operator through the indicating and operating system 66 of adjustments carried out.

What is claimed is:

1. A method for controlling a snow-trail grooming vehicle, comprising the steps of:

providing a snow-trail grooming vehicle having a drive motor for providing driving power, a chain or track drive, a hydraulic pump driven by the drive motor and a hydrostatic gear of the chain or track drive, further consumers of driving power comprising at least one of a snow-trail grooming device and a cable winch, means for distributing driving power onto the chain or track drive and the snow-trail grooming device and cable winch, and a central processing system for controlling said means for distributing driving power;

selectively prioritizing one of the chain or track drive, the snow-trail grooming device and the cable winch;

correlating the adjustments of the drive motor, the hydraulic pump driven by the drive motor and the hydrostatic gear of the chain or track drive under the control of the central processing system in order to obtain the desired distribution of the driving power with little power loss; and distributing the driving power according to the desired distribution.

2. The method according to claim 1, wherein the prioritizing step further includes specifying threshold values for the driving power available to said further consumers of driving power and said chain or track drive.

3. The method according to claim 1, wherein the prioritizing step further includes specifying threshold values for at least one of output parameters of the chain or track drive and output parameters of said further consumers of driving power.

4. The method according to claim 1, further comprising the step of:

detecting environmental parameters and indicating a change of the prioritizing, in dependency of the environmental parameters, by the central processing system to an operator.

5. The method according to claim 4, further comprising the step of automatically carrying out the change of the prioritizing by the central processing system in dependency of the environmental parameters.

6. The method according to claim 1, wherein the hydraulic pump is configured to provide braking power, the method further comprising the step of distributing the braking power onto said further consumers of driving power under control of the central processing system.

7. A snow trail grooming vehicle comprising:

a drive motor for providing driving power, a controllable hydraulic pump driven by the drive motor, a chain or track drive, at least one controllable hydrostatic gear for the chain or track drive, further consumers of driving power comprising at least one of a snow-trail grooming device and a cable winch, means for distributing driving power onto the chain or track drive and said further consumers of driving power, and a central processing system for controlling said means for distributing driving power, wherein the central processing system includes means for specifying a changeable prioritizing of at least one of the chain or track drive and the further consumers of driving power and means for correlating adjustments of the drive motor, the hydraulic pump and the at least one hydrostatic gear, such correlating being performed with regard to little loss of power.

8. The snow trail grooming vehicle according to claim 7, wherein the central processing system has means for specifying threshold values for the driving power, said threshold values limiting the driving power made available to the chain or track drive and said further consumers of driving power.

9. The snow trail grooming vehicle according to claim 7, wherein the central processing system has means for specifying threshold values for output parameters of the chain or track drive and said further consumers of driving power.

10. The snow trail grooming vehicle according to claim 7, further comprising means for determining environmental parameters.

11. The snow trail grooming vehicle according to claim 10, wherein the environmental parameters comprise at least one of slope incline, cable-winch operation, density of the snow, temperature of the snow and height of the snow.

12. The snow trail grooming vehicle according to claim 7, further comprising the central processing system having means for distributing hydraulic braking power onto said further consumers of driving power.

* * * * *